US008384297B2

(12) United States Patent
Quayle et al.

(10) Patent No.: US 8,384,297 B2
(45) Date of Patent: Feb. 26, 2013

(54) METHOD OF CONTROLLING AN OPERATING FREQUENCY OF AN ELECTRONIC DIMMING BALLAST

(75) Inventors: Jonathan Robert Quayle, Bethlehem, PA (US); Venkatesh Chitta, Center Valley, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 128 days.

(21) Appl. No.: 12/858,662

(22) Filed: Aug. 18, 2010

(65) Prior Publication Data

US 2012/0043903 A1 Feb. 23, 2012

(51) Int. Cl.
*H05B 41/36* (2006.01)

(52) U.S. Cl. ..... 315/224; 324/414

(58) Field of Classification Search ..... 315/224, 315/225, 226, 282, 291, 307, 308, 324, 209 R; 324/414

See application file for complete search history.

(56) References Cited

U.S. PATENT DOCUMENTS

| | | | | |
|---|---|---|---|---|
| 4,277,728 | A | 7/1981 | Stevens | |
| 5,144,205 | A | 9/1992 | Motto et al. | |
| 6,452,344 | B1 * | 9/2002 | MacAdam et al. | 315/307 |
| 6,642,669 | B1 | 11/2003 | MacAdam et al. | |
| 6,791,279 | B1 | 9/2004 | Shearer et al. | |
| 7,489,090 | B2 | 2/2009 | Taipale | |
| 7,586,268 | B2 | 9/2009 | Gawrys et al. | |
| 7,619,539 | B2 | 11/2009 | Veskovic et al. | |
| 8,008,866 | B2 * | 8/2011 | Newman et al. | 315/224 |
| 8,049,432 | B2 * | 11/2011 | Taipale et al. | 315/282 |
| 8,067,902 | B2 * | 11/2011 | Newman et al. | 315/307 |
| 2004/0183450 | A1 | 9/2004 | Busse et al. | |
| 2010/0060186 | A1 * | 3/2010 | Taipale et al. | 315/291 |
| 2010/0060200 | A1 * | 3/2010 | Newman et al. | 315/307 |
| 2012/0001556 | A1 * | 1/2012 | Newman et al. | 315/182 |
| 2012/0044599 | A1 * | 2/2012 | Veskovic | 361/18 |

FOREIGN PATENT DOCUMENTS

| | | |
|---|---|---|
| WO | WO 00/30414 | 5/2000 |

OTHER PUBLICATIONS

European Patent Office, International Search Report and Written Opinion for International Patent Application No. PCT/US2011/047917, Oct. 28, 2011, 10 pages.

* cited by examiner

*Primary Examiner* — Daniel D Chang
(74) *Attorney, Agent, or Firm* — Mark E. Rose; Philip N. Smith; Bridget L. McDonough

(57) ABSTRACT

An electronic ballast for driving a gas discharge lamp comprises an inverter circuit, a resonant tank circuit, and a control circuit operable to determine an approximation of a resonant frequency of the resonant tank circuit and to control the inverter circuit in response to the approximation of the resonant frequency. The control circuit determines the approximation of the resonant frequency by adjusting an operating frequency of a high-frequency inverter output voltage provided to the resonant tank circuit from a frequency above the resonant frequency down towards the resonant frequency, measuring the magnitude of a lamp voltage across the lamp, and storing the present value of the operating frequency as the resonant frequency when the magnitude of the lamp voltage reaches a maximum value. The control circuit may control the operating frequency of the inverter output voltage in response to the approximation of the resonant frequency and a target intensity of the lamp.

17 Claims, 6 Drawing Sheets

METHOD OF CONTROLLING AN OPERATING FREQUENCY OF AN ELECTRONIC DIMMING BALLAST

BACKGROUND OF THE INVENTION

1. Field of the Invention

The present invention relates to an electronic dimming ballast, and more particularly, to a method of determining an approximation of a resonant frequency of a resonant tank circuit of an electronic dimming ballast, and adjusting an operating frequency of the ballast in response to the approximation of the resonant frequency.

2. Description of the Related Art

Prior art electronic ballasts for fluorescent lamps typically comprise a "front-end" circuit and a "back-end" circuit. The front-end circuit often includes a rectifier for receiving an alternating-current (AC) mains line voltage and producing a rectified voltage $V_{RECT}$, and a boost converter for receiving the rectified voltage $V_{RECT}$ and generating a direct-current (DC) bus voltage $V_{BUS}$ across a bus capacitor. The boost converter is an active circuit for boosting the magnitude of the DC bus voltage above the peak of the line voltage and for improving the total harmonic distortion (THD) and the power factor of the input current to the ballast. The back-end circuit typically includes a switching inverter circuit for converting the DC bus voltage $V_{BUS}$ to a high-frequency inverter output voltage $V_{INV}$ (e.g., a square-wave voltage), and a resonant tank circuit for generating a sinusoidal voltage $V_{SIN}$ from the inverter output voltage $V_{INV}$ and coupling the sinusoidal voltage $V_{SIN}$ to the lamp electrodes. The amount of power delivered to the lamp may be adjusted by controlling a duty cycle $DC_{INV}$ of the inverter output voltage $V_{INV}$ to thus control the intensity of the lamp from a low-end intensity $L_{LE}$ to a high-end intensity $L_{HE}$. An operating frequency $f_{OP}$ of the inverter output voltage $V_{INV}$ may be held constant for much of the dimming range of the lamp between the low-end intensity $L_{LE}$ to the high-end intensity $L_{HE}$.

In order for the resonant tank circuit to provide an appropriate amount of output impedance to the lamp, such that the lamp intensity is stable and does not flicker when controlled to the low-end intensity $L_{LE}$, the operating frequency $f_{OP}$ of the inverter output voltage $V_{INV}$ is typically controlled to a low-end frequency $f_{LE}$ that is slightly above a resonant frequency $f_{RES}$ of the resonant tank circuit at the low-end intensity $L_{LE}$. However, if the operating frequency $f_{OP}$ of the inverter output voltage $V_{INV}$ is controlled too close to the resonant frequency $f_{RES}$, the reverse recovery of diodes in the inverter circuit may cause noise and increased temperatures in the inverter circuit. Therefore, there is a frequency window above the resonant frequency $f_{RES}$ in which the operating frequency $f_{OP}$ of the inverter output voltage $V_{INV}$ must be controlled when the lamp is at the low-end intensity $L_{LE}$. Since the resonant frequency $f_{RES}$ is dependent upon the tolerances of the components of the resonant tank circuit, the components of the resonant tank circuit as well as the value of the low-end frequency $f_{LE}$ must be carefully chosen to ensure that the operating frequency $f_{OP}$ of the inverter output voltage $V_{INV}$ is within the frequency window when the lamp is at the low-end intensity $L_{LE}$. Accordingly, there is a need for an electronic dimming ballast that is able to more accurately control the operating frequency $f_{OP}$ of the inverter output voltage $V_{INV}$ with respect to the resonant frequency $f_{RES}$ when the lamp intensity is controlled near the low-end intensity $L_{LE}$.

SUMMARY OF THE INVENTION

According to an embodiment of the present invention, an electronic ballast for driving a gas discharge lamp comprises an inverter circuit, a resonant tank circuit, and a control circuit operable to determine an approximation of a resonant frequency of the resonant tank circuit and to control the inverter circuit in response to the approximation of the resonant frequency. The inverter circuit converts a DC bus voltage to a high-frequency output voltage having an operating frequency and an operating duty cycle. The resonant tank circuit couples the high-frequency output voltage to the lamp to generate a lamp current through the lamp and a lamp voltage across the lamp. The control circuit is coupled to the inverter circuit for controlling the operating frequency and the operating duty cycle of the high-frequency output voltage, so as to adjust the intensity of the lamp to a target intensity. The control circuit is operable to control the operating frequency of the high-frequency output voltage in response to the approximation of the resonant frequency and the target intensity of the lamp. According to one embodiment of the present invention, the control circuit may be operable to control the duty cycle of the high-frequency output voltage to adjust the magnitude of the lamp current through the lamp, so as to control the intensity of the lamp to the target intensity. In addition, the control circuit may be operable to control the operating frequency of the high-frequency output voltage to a low-end frequency when the target intensity of the lamp is at a low-end intensity, where the low-end frequency is an offset frequency away from the approximation of the resonant frequency. According to another embodiment of the present invention, the control circuit may control the duty cycle of the high-frequency output voltage to a minimum value prior to adjusting the operating frequency of the high-frequency output voltage down towards the resonant frequency.

According to another embodiment of the present invention, a method of determining an approximation of a resonant frequency of a resonant tank circuit of an electronic ballast for driving a gas discharge lamp comprises: (1) providing a high-frequency output voltage having an operating frequency and an operating duty cycle to the resonant tank circuit; (2) the resonant tank circuit coupling the high-frequency output voltage to the lamp to generate a lamp current through the lamp and a lamp voltage across the lamp; (3) adjusting the operating frequency of the high-frequency output voltage from a frequency above the resonant frequency of the resonant tank circuit down towards the resonant frequency; (4) measuring the magnitude of the lamp voltage; and (5) storing the present value of the operating frequency of the high-frequency output voltage as the resonant frequency when the magnitude of the lamp voltage reaches a maximum value. According to one embodiment of the present invention, the method may comprise controlling the duty cycle of the high-frequency output voltage to a minimum value prior to adjusting the operating frequency of the high-frequency output voltage down towards the resonant frequency. According to another embodiment of the present invention, the method may comprise controlling the operating frequency of the high-frequency output voltage to a low-end frequency when the target intensity of the lamp is at a low-end intensity, the low-end frequency being an offset frequency above the measured resonant frequency.

In addition, a method of driving a gas discharge lamp in an electronic dimming ballast having a resonant tank circuit characterized by a resonant frequency is described herein. The method comprises: (1) providing a high-frequency output voltage having an operating frequency and an operating duty cycle to the resonant tank circuit; (2) the resonant tank circuit coupling the high-frequency output voltage to the lamp to generate a lamp current through the lamp and a lamp voltage across the lamp; (3) controlling the operating duty cycle of the high-frequency output voltage, so as to adjust the intensity of the lamp to a target intensity; (4) determining an approximation of the resonant frequency of the resonant tank circuit; and (5) automatically adjusting the operating frequency of the high-frequency output voltage in response to the approximation of the resonant frequency and the target intensity of the lamp by controlling the operating frequency of the high-frequency output voltage to a low-end frequency when the target intensity of the lamp is at a low-end intensity, the low-end frequency being an offset frequency above the approximation of the resonant frequency. According to another embodiment of the present invention, the method may comprise controlling the duty cycle of the high-frequency output voltage to a minimum value; subsequently adjusting the operating frequency of the high-frequency output voltage from a frequency above the resonant frequency of the resonant tank circuit down towards the resonant frequency; measuring the magnitude of the lamp voltage in response to adjusting the operating frequency of the high-frequency output voltage; and storing the present value of the operating frequency of the high-frequency output voltage as an approximation of the resonant frequency when the magnitude of the lamp voltage reaches a maximum value.

Other features and advantages of the present invention will become apparent from the following description of the invention that refers to the accompanying drawings.

BRIEF DESCRIPTION OF THE DRAWINGS

The invention will now be described in greater detail in the following detailed description with reference to the drawings in which:

FIG. 4 is a simplified flowchart of the lamp strike procedure executed by a microprocessor of the ballast of FIG. 1 when the ballast receives a command to turn the lamp on;

DETAILED DESCRIPTION OF THE INVENTION

Figure 1:
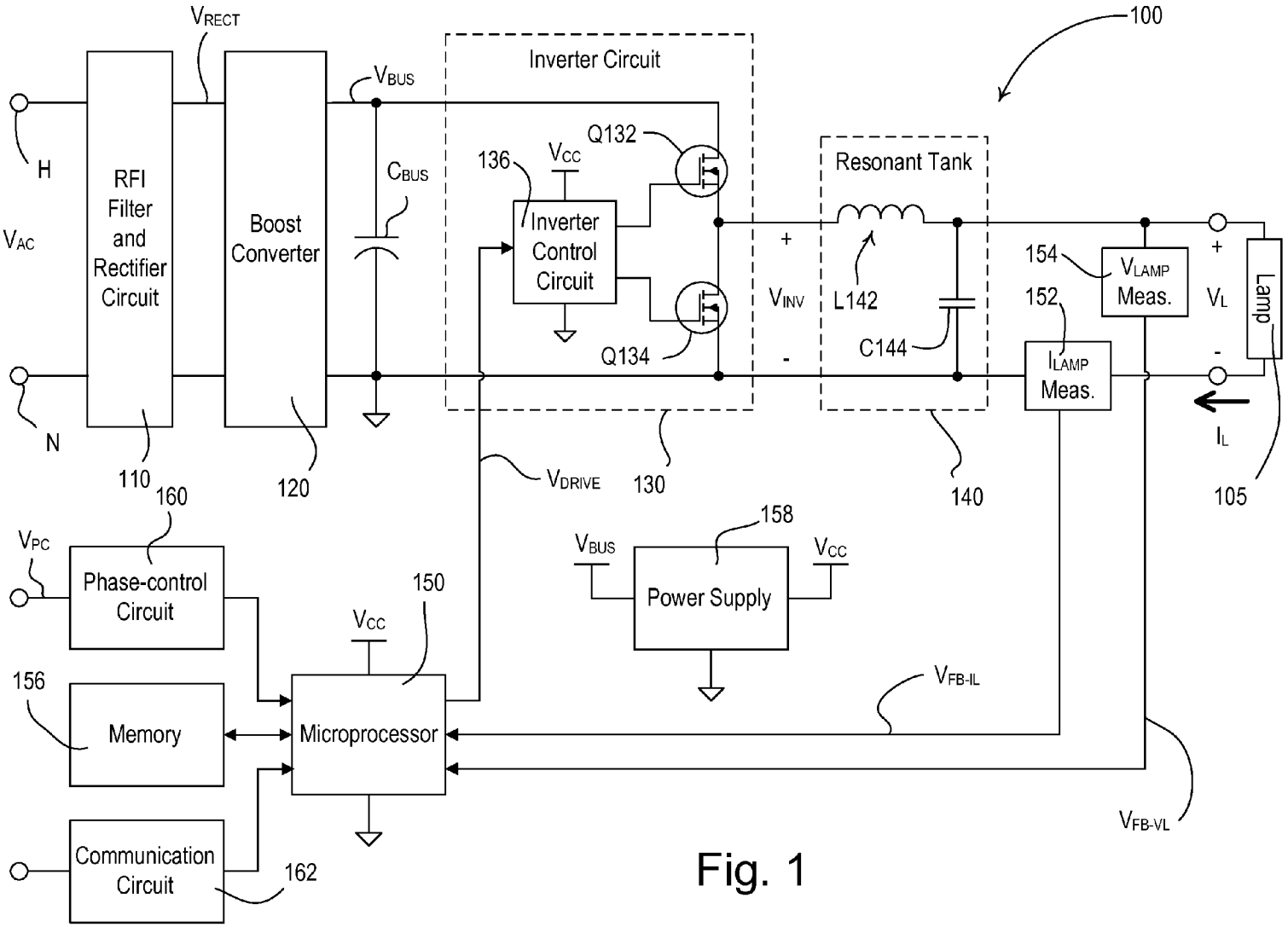
FIG. 1 is a simplified block diagram of an electronic dimming ballast for driving a fluorescent lamp according to an embodiment of the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a simplified block diagram of an electronic dimming ballast 100 according to an embodiment of the present invention. The ballast 100 comprises a hot terminal H and a neutral terminal N that are adapted to be coupled to an alternating-current (AC) power source (not shown) for receiving an AC mains line voltage $V_{AC}$. The ballast 100 is adapted to be coupled between the AC power source and a gas discharge lamp (e.g., a fluorescent lamp 105), such that the ballast is operable to control the amount of power delivered to the lamp and thus the intensity of the lamp. The ballast 100 comprises an RFI (radio frequency interference) filter and rectifier circuit 110 for minimizing the noise provided on the AC mains, and producing a rectified voltage $V_{RECT}$ from the AC mains line voltage $V_{AC}$. The ballast 100 further comprises a boost converter 120 for generating a direct-current (DC) bus voltage $V_{BUS}$ across a bus capacitor $C_{BUS}$. The DC bus voltage $V_{BUS}$ typically has a magnitude (e.g., 465 V) that is greater than the peak magnitude $V_{PK}$ of the AC mains line voltage $V_{AC}$ (e.g., 170 V). The boost converter 120 also operates as a power-factor correction (PFC) circuit for improving the power factor of the ballast 100. The ballast 100 also includes an inverter circuit 130 for converting the DC bus voltage $V_{BUS}$ to a high-frequency inverter output voltage $V_{INV}$ (e.g., a square-wave voltage), and a resonant tank circuit 140 for coupling the high-frequency inverter output voltage generated by the inverter circuit to filaments of the lamp 105.

The ballast 100 further comprises a control circuit, e.g., a microprocessor 150, which is coupled to the inverter circuit 130 for turning the lamp 105 on and off and adjusting the intensity of the lamp 105 to a target intensity $L_{TARGET}$ between a low-end (i.e., minimum) intensity $L_{LE}$ (e.g., 1%) and a high-end (i.e., maximum) intensity $L_{HE}$ (e.g., 100%). The microprocessor 150 may alternatively be implemented as a microcontroller, a programmable logic device (PLD), an application specific integrated circuit (ASIC), or any suitable type of controller or control circuit. The microprocessor 150 provides a drive control signal $V_{DRIVE}$ to the inverter circuit 130 and may control one or both of two operational parameters of the inverter circuit (e.g., an operating frequency $f_{OP}$ and an operating duty cycle $DC_{INV}$) to control the magnitudes of a lamp voltage $V_L$ generated across the lamp 105 and a lamp current $I_L$ conducted through the lamp. The microprocessor 150 receives a lamp current feedback signal $V_{FB\text{-}IL}$, which is generated by a lamp current measurement circuit 152 and is representative of the magnitude of the lamp current $I_L$. The microprocessor 150 also receives a lamp voltage feedback signal $V_{FB\text{-}VL}$, which is generated by a lamp voltage measurement circuit 154 and is representative of the magnitude of the lamp voltage $V_L$.

The ballast 100 also comprises a memory 156, which is coupled to the microprocessor 150 for storing the target intensity $L_{TARGET}$ and other operational characteristics of the ballast. The memory 156 may be implemented as an external integrated circuit (IC) or as an internal circuit of the microprocessor 150. A power supply 158 receives the bus voltage $V_{BUS}$ and generates a DC supply voltage $V_{CC}$ (e.g., approximately five volts) for powering the microprocessor 150, the memory 156, and other low-voltage circuitry of the ballast 100.

The ballast 100 may comprise a phase-control circuit 160 for receiving a phase-control voltage $V_{PC}$ (e.g., a forward or reverse phase-control signal) from a standard phase-control dimmer (not shown). The microprocessor 150 is coupled to the phase-control circuit 160, such that the microprocessor is operable to determine the target intensity $L_{TARGET}$ for the lamp 105 from the phase-control voltage $V_{PC}$. The ballast 100 may also comprise a communication circuit 162, which is coupled to the microprocessor 150 and allows the ballast to communicate (i.e., transmit and receive digital messages)

with the other control devices on a communication link (not shown), e.g., a wired communication link or a wireless communication link, such as a radio-frequency (RF) or an infrared (IR) communication link. Examples of ballasts having communication circuits are described in greater detail in commonly-assigned U.S. Pat. No. 7,489,090, issued Feb. 10, 2009, entitled ELECTRONIC BALLAST HAVING ADAPTIVE FREQUENCY SHIFTING; U.S. Pat. No. 7,528,554, issued May 5, 2009, entitled ELECTRONIC BALLAST HAVING A BOOST CONVERTER WITH AN IMPROVED RANGE OF OUTPUT POWER; and U.S. patent application Ser. No. 11/787,934, filed Apr. 18, 2007, entitled COMMUNICATION CIRCUIT FOR A DIGITAL ELECTRONIC DIMMING BALLAST, the entire disclosures of which are hereby incorporated by reference.

The inverter circuit 130 comprises first and second series-connected switching devices (e.g., FETs Q132, Q134) and an inverter control circuit 136, which controls the FETs in response to the drive control signal $V_{DRIVE}$ from the microprocessor 150. The inverter control circuit 136 may comprise, for example, an integrated circuit (IC), such as part number NCP5111, manufactured by On Semiconductor. The inverter control circuit 136 may control the FETs Q132, Q134 using a d(1−d) complementary switching scheme, in which the first FET Q132 has a duty cycle of d (i.e., equal to the duty cycle $DC_{INV}$) and the second FET Q134 has a duty cycle of 1−d, such that only one FET is conducting at a time. When the first FET Q132 is conductive, the output of the inverter circuit 130 is pulled up towards the bus voltage $V_{BUS}$. When the second FET Q134 is conductive, the output of the inverter circuit 130 is pulled down towards circuit common. The magnitude of the lamp current $I_L$ conducted through the lamp 105 is controlled by adjusting the operating frequency $f_{OP}$ and/or the duty cycle $DC_{OP}$ of the high-frequency inverter output voltage $V_{INV}$ generated by the inverter circuit 130.

The resonant tank circuit 140 comprises a resonant inductor L142 adapted to be coupled in series between the inverter circuit 130 and the lamp 105, and a resonant capacitor C144 adapted to be coupled in parallel with the lamp. For example, the inductor L142 may have an inductance $L_{142}$ of approximately 13.4 mH, while the resonant capacitor C144 may have a capacitance $C_{144}$ of approximately 1.2 nF. The resonant tank circuit 140 is characterized by a resonant frequency $f_{RES}$, i.e., $$f_{RES}=1/\sqrt{(L_{142}\cdot C_{144})},$$

such that the resonant frequency $f_{RES}$ may be, for example, approximately 250 kHz. According to an embodiment of the present invention, the microprocessor 150 is operable to determine an approximation of the resonant frequency $f_{RES}$ of the resonant tank circuit 140 (e.g., measure the resonant frequency), and use the approximation of the resonant frequency $f_{RES}$ during normal operation of the ballast 100, as will be described in greater detail below. In other words, the microprocessor 150 is operable to calibrate the resonant frequency $f_{RES}$ of the resonant tank circuit 140 in order to determine a more accurate value of the resonant frequency $f_{RES}$ that is not dependent upon the worst case tolerances of the components of the resonant tank circuit.

When the microprocessor 150 receives a command to turn the lamp 105 on, the microprocessor 150 first preheats filaments of the lamp 105 and then attempts to strike the lamp during a lamp strike procedure 200, which will be described in greater detail below with reference to FIG. 4. The resonant tank circuit 140 may comprise a plurality of filament windings (not shown) that are magnetically coupled to the resonant inductor L142 for generating filament voltages for heating the filaments of the lamp 105 prior to striking the lamp. An example of a ballast having a circuit for heating the filaments of a fluorescent lamp is described in greater detail in U.S. Pat. No. 7,586,268, issued Sep. 8, 2009, titled APPARATUS AND METHOD FOR CONTROLLING THE FILAMENT VOLTAGE IN AN ELECTRONIC DIMMING BALLAST, the entire disclosure of which is hereby incorporated by reference.

Figure 2:
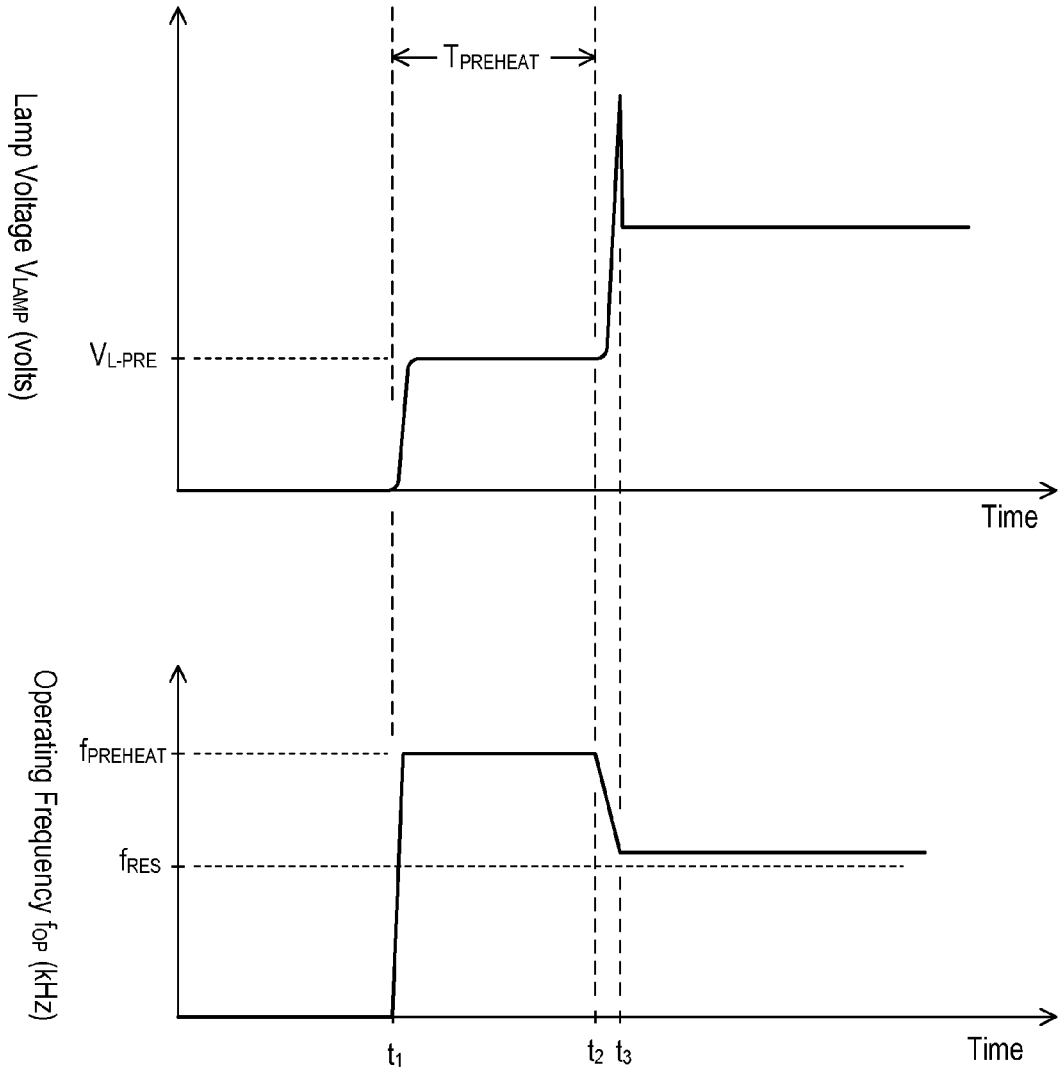
FIG. 2 shows example timing diagrams of the magnitude of a lamp voltage developed across the lamp and an operating frequency of an inverter circuit of the ballast of FIG. 1 while attempting to strike the lamp.

FIG. 2 shows example timing diagrams of the magnitude of the lamp voltage $V_L$ and the operating frequency $f_{OP}$ of the inverter circuit 130 during the lamp strike procedure 200. After receiving a command to strike the lamp 105 (i.e., at time $t_1$ in FIG. 2), the microprocessor 150 first preheats the filaments of the lamp for a preheat time period $T_{PREHEAT}$ by controlling the operating frequency $f_{OP}$ of the inverter circuit 130 to a preheat frequency $f_{PREHEAT}$, e.g., approximately 130 kHz (which causes the lamp voltage $V_{LAMP}$ to be controlled to a preheat voltage $V_{L\text{-}PRE}$). After the preheat time period $T_{PREHEAT}$ (i.e., at time $t_2$ in FIG. 2) the microprocessor 150 sweeps the operating frequency $f_{OP}$ of the inverter circuit 130 down from the preheat frequency $f_{PREHEAT}$ towards the resonant frequency $f_{RES}$ of the resonant tank circuit 140, such that the magnitude of the lamp voltage $V_L$ increases until the lamp 105 strikes (i.e., at time $t_3$ in FIG. 2). When the lamp 105 strikes, the magnitude of the lamp voltage $V_L$ decreases and the magnitude of the lamp current $I_L$ increases, and, as a result, the microprocessor 150 is able to detect the lamp strike in response to the lamp voltage feedback signal $V_{FB\text{-}VL}$ and the lamp current feedback signal $V_{FB\text{-}IL}$.

Figure 3:
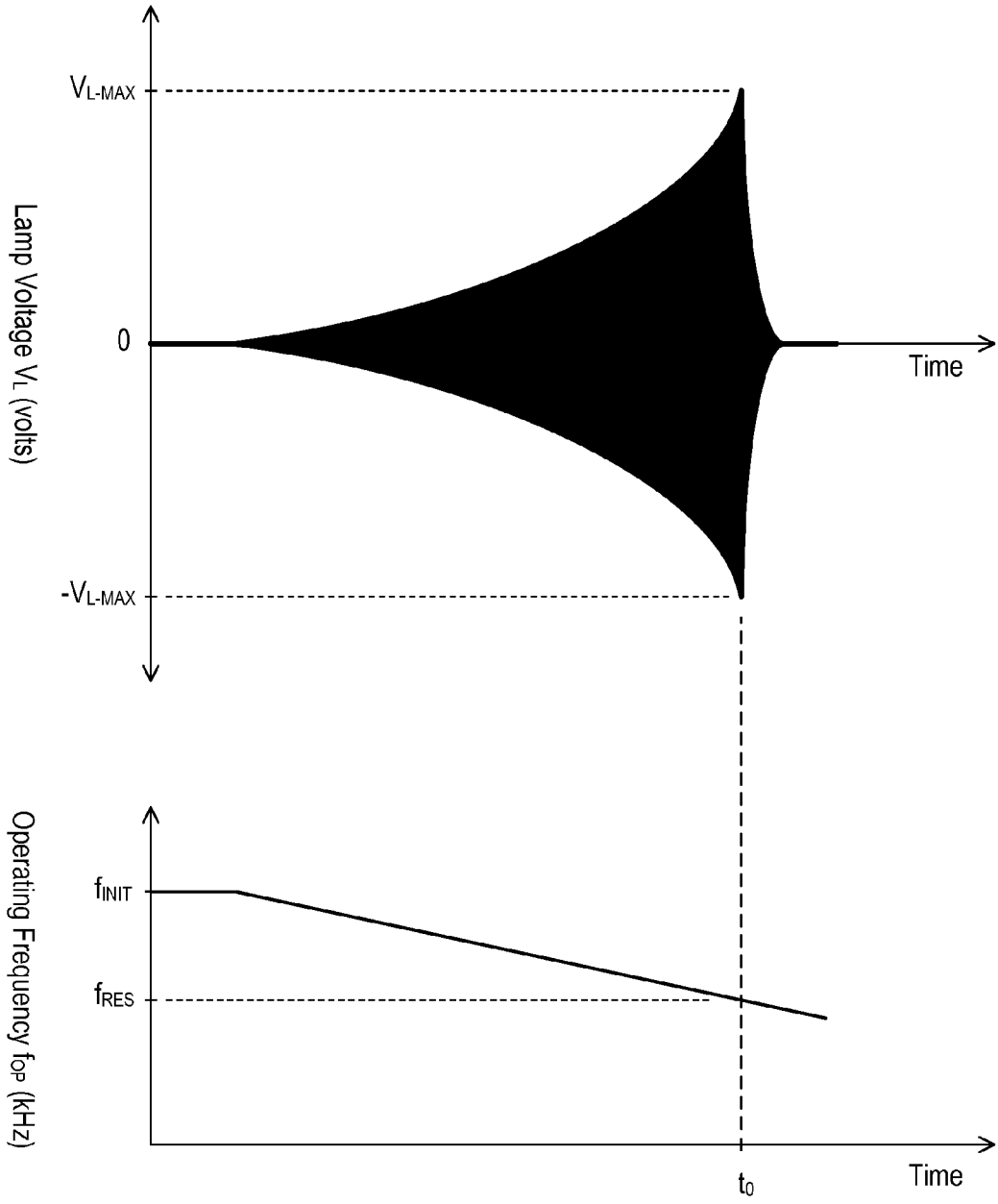
FIG. 3 shows example waveforms of the magnitude of the lamp voltage and the operating frequency of the inverter circuit of the ballast of FIG. 1 during a resonant frequency detection procedure according to the embodiment of the present invention.

According to the embodiment of the present invention, the microprocessor 150 is operable to execute a resonant frequency detection procedure 300 to determine an approximation of the resonant frequency $f_{RES}$ of the resonant tank circuit 140 prior to preheating the filaments and attempting to strike the lamp 105. FIG. 3 shows example waveforms of the magnitude of the lamp voltage $V_L$ and the operating frequency $f_{OP}$ of the inverter circuit 130 during the resonant frequency detection procedure 300. During the resonant frequency detection procedure 300, the microprocessor 150 controls the duty cycle $DC_{INV}$ of the inverter output voltage $V_{INV}$ to a minimum duty cycle $DC_{MIN}$ (e.g., approximately 3%), such the lamp 105 will not be illuminated during the resonant frequency detection procedure 300. The microprocessor 150 then sweeps the operating frequency $f_{OP}$ of the inverter circuit 130 from an initial operating frequency $f_{INIT}$ down towards the resonant frequency $f_{RES}$, and monitors the magnitude of the lamp voltage $V_L$ (using the lamp voltage feedback signal $V_{FB\text{-}VL}$). For example, the initial operating frequency $f_{INIT}$ may be equal to the preheat frequency $f_{PREHEAT}$, i.e., approximately 130 kHz). The magnitude of the lamp voltage $V_L$ will reach a maximum value $V_{L\text{-}MAX}$ when the operating frequency $f_{OP}$ of the inverter circuit 130 is at the resonant frequency $f_{RES}$ (as shown at time $t_0$ in FIG. 3). Accordingly, the microprocessor 150 stores the value of the operating frequency $f_{OP}$ (when the magnitude of the lamp voltage $V_L$ reaches the maximum value $V_{L\text{-}MAX}$) as the resonant frequency $f_{RES}$ in the memory 156.

The microprocessor 150 may be operable to determine the approximation of the resonant frequency $f_{RES}$ in response to receiving a digital message via the communication circuit 162, for example, during manufacturing of the ballast. In addition, the microprocessor 150 may be operable to execute the resonant frequency detection procedure 300 to determine the approximation of the resonant frequency $f_{RES}$ each time the lamp 105 is turned on. Alternatively, the microprocessor 150 could be operable to periodically determine the approximation of the resonant frequency $f_{RES}$ when the lamp 105 is off, or to determine the approximation of the resonant frequency $f_{RES}$ immediately after the lamp is turned off, for example, each time the lamp is turned off.

When the target intensity $L_{TARGET}$ of the lamp 105 is at or near the low-end intensity $L_{LE}$, the microprocessor 150 controls the operating frequency $f_{OP}$ to be close to the resonant frequency $f_{RES}$ to provide an appropriate ballasting impedance for stable lamp operation, but not so close to the resonant frequency that excessive noise and heat are generated in the inverter circuit 130. Specifically, when the target intensity $L_{TARGET}$ is less than or equal to a threshold intensity $L_{TH}$ (e.g., approximately 50%), the operating frequency $f_{OP}$ is controlled to a low-end operating frequency $f_{LE}$. For example, the low-end operating frequency $f_{LE}$ may be equal to approximately the approximation of the resonant frequency $f_{RES}$ (from the resonant frequency detection procedure 300) plus an offset frequency $f_{OFFSET}$ (e.g., approximately two kHz). When the target intensity $L_{TARGET}$ is greater than the threshold intensity $L_{TH}$, the operating frequency $f_{OP}$ may be adjusted in response to the target intensity $L_{TARGET}$ of the lamp 105 (e.g., to decrease the operating frequency $f_{OP}$ as the target intensity $L_{TARGET}$ increases according to a predetermined relationship). In addition, the microprocessor 150 may control the operating frequency $f_{OP}$ in response to the approximation of the resonant frequency $f_{RES}$ when the target intensity $L_{TARGET}$ is greater than the threshold intensity $L_{TH}$.

Figure 4:
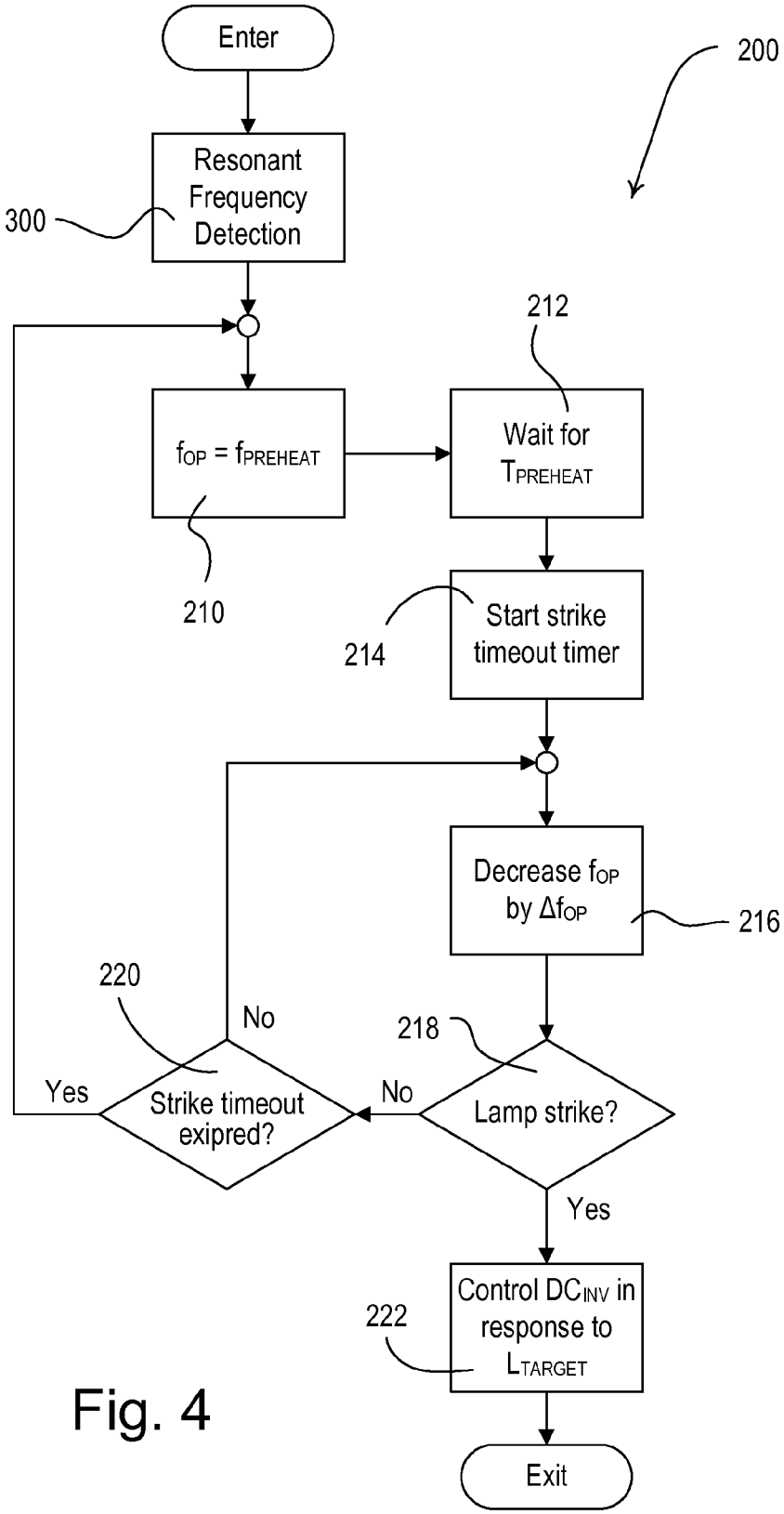

FIG. 4 is a simplified flowchart of the lamp strike procedure 200 that is executed by the microprocessor 150 when the ballast 100 receives a command to turn the lamp 105 on. Before preheating the filaments and attempting to strike the lamp 105, the microprocessor 150 first determines the approximation of the resonant frequency $f_{RES}$ by executing the resonant frequency detection procedure 300, which will be described in greater detail below with reference to FIG. 4. After executing the resonant frequency detection procedure 300, the microprocessor 150 controls the operating frequency $f_{OP}$ of the inverter circuit 130 to the preheat frequency $f_{PREHEAT}$ at step 210, and waits for the length of the preheat time period $T_{PREHEAT}$ at step 212. After preheating the filaments for the preheat time period $T_{PREHEAT}$, the microprocessor 150 attempts to strike the lamp 105. Specifically, the microprocessor 150 starts a strike timeout timer at step 214 and decreases the operating frequency $f_{OP}$ by a predetermined frequency value $\Delta f_{OP}$ (e.g., approximately 150 Hz) at step 216. The microprocessor 150 continues to decrease the operating frequency $f_{OP}$ by the predetermined frequency value $\Delta f_{OP}$ at step 216 until the lamp strikes at step 218 or the strike timeout timer expires at step 220. When the strike timeout timer expires at step 220, the microprocessor 150 preheats the filaments and tries to strike the lamp 105 once again at steps 210-220. When the lamp 105 has been struck at step 218, the microprocessor 150 adjusts the duty cycle $DC_{INV}$ of the inverter output voltage $V_{INV}$ of the inverter circuit 130 (i.e., via the drive control signal $V_{DRIVE}$) in response to the target intensity $L_{TARGET}$ of the lamp at step 222, before the lamp strike procedure 200 exits.

Figure 5:
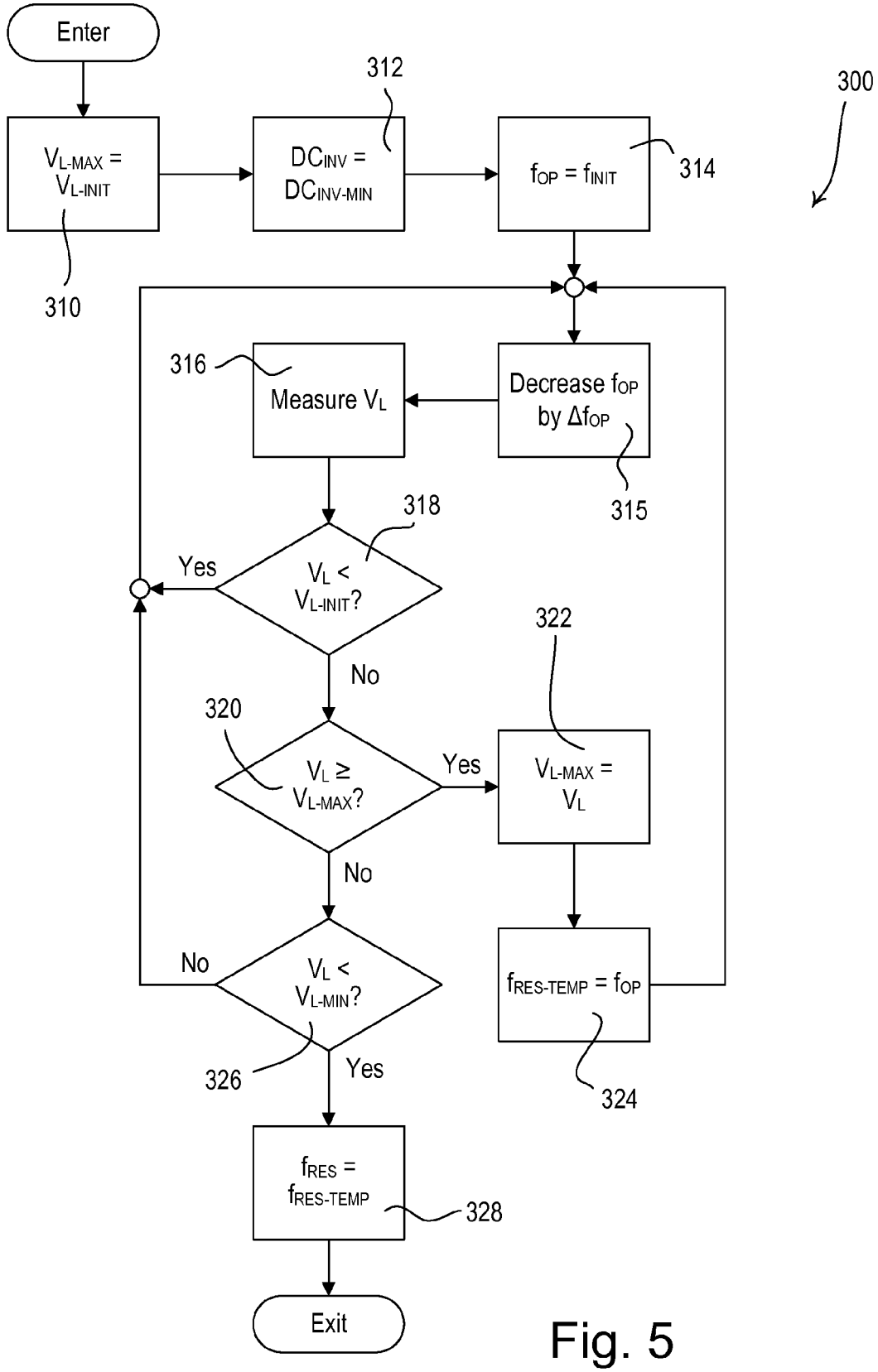
FIG. 5 is a simplified flowchart of the resonant frequency detection procedure executed by the microprocessor of the ballast of FIG. 1 according to the embodiment of the present invention.

FIG. 5 is a simplified flowchart of the resonant frequency detection procedure 300 that is executed by the microprocessor 150 prior to preheating the filaments and attempting to strike the lamp 105 during the lamp strike procedure 200 of FIG. 4. The microprocessor 150 first initializes the maximum lamp voltage value $V_{L\text{-}MAX}$ to an initial lamp voltage value $V_{L\text{-}INIT}$ (e.g., approximately 150 volts) at step 310, and controls the duty cycle $DC_{INV}$ of the inverter output voltage $V_{INV}$ to the minimum duty cycle $DC_{MIN}$ at step 312, such the lamp 105 will not be illuminated during the resonant frequency detection procedure 300. The microprocessor 150 then controls the operating frequency to the initial operating frequency $f_{INIT}$ at step 314, decreases the operating frequency $f_{OP}$ by the predetermined frequency value $\Delta f_{OP}$ at step 315, and measures the magnitude of the lamp voltage $V_L$ using the lamp voltage feedback signal $V_{FB\text{-}VL}$ at step 316. If the measured magnitude of the lamp voltage $V_L$ from step 316 is less than the initial lamp voltage value $V_{L\text{-}INIT}$ at step 318, the microprocessor 150 once again decreases the operating frequency $f_{OP}$ by the predetermined frequency value $\Delta f_{OP}$ at step 315 and measures the resulting magnitude of the lamp voltage $V_L$ at step 316.

When the measured magnitude of the lamp voltage $V_L$ is greater than the initial lamp voltage value $V_{L\text{-}INIT}$ at step 318, the microprocessor 150 then determines if the measured magnitude of the lamp voltage $V_L$ is greater than or equal to the maximum lamp voltage value $V_{L\text{-}MAX}$ at step 320. If so, the microprocessor 150 updates the maximum lamp voltage value $V_{L\text{-}MAX}$ to be equal to the measured magnitude of the lamp voltage $V_L$ at step 322, and sets a temporary resonant frequency $f_{RES\text{-}TEMP}$ equal to the present value of the operating frequency $f_{OP}$ at step 324, before decreasing the operating frequency $f_{OP}$ by the predetermined frequency value $\Delta f_{OP}$ once again at step 315. If the measured magnitude of the lamp voltage $V_L$ has fallen below the maximum lamp voltage value $V_{L\text{-}MAX}$ at step 320, but is still greater than a minimum lamp voltage value $V_{L\text{-}MIN}$ (e.g., approximately 50 volts) at step 326, the microprocessor 150 continues to decrease the operating frequency $f_{OP}$ at step 315 and compares the measured magnitude of the lamp voltage $V_L$ to the maximum lamp voltage value $V_{L\text{-}MAX}$ at step 320. When the measured magnitude of the lamp voltage $V_L$ drops below the minimum lamp voltage value $V_{L\text{-}MIN}$ at step 326, the microprocessor 150 sets the resonant frequency $f_{RES}$ equal to the temporary resonant frequency $f_{RES\text{-}TEMP}$ at step 328, and the resonant frequency detection procedure 300 exits.

Figure 6:
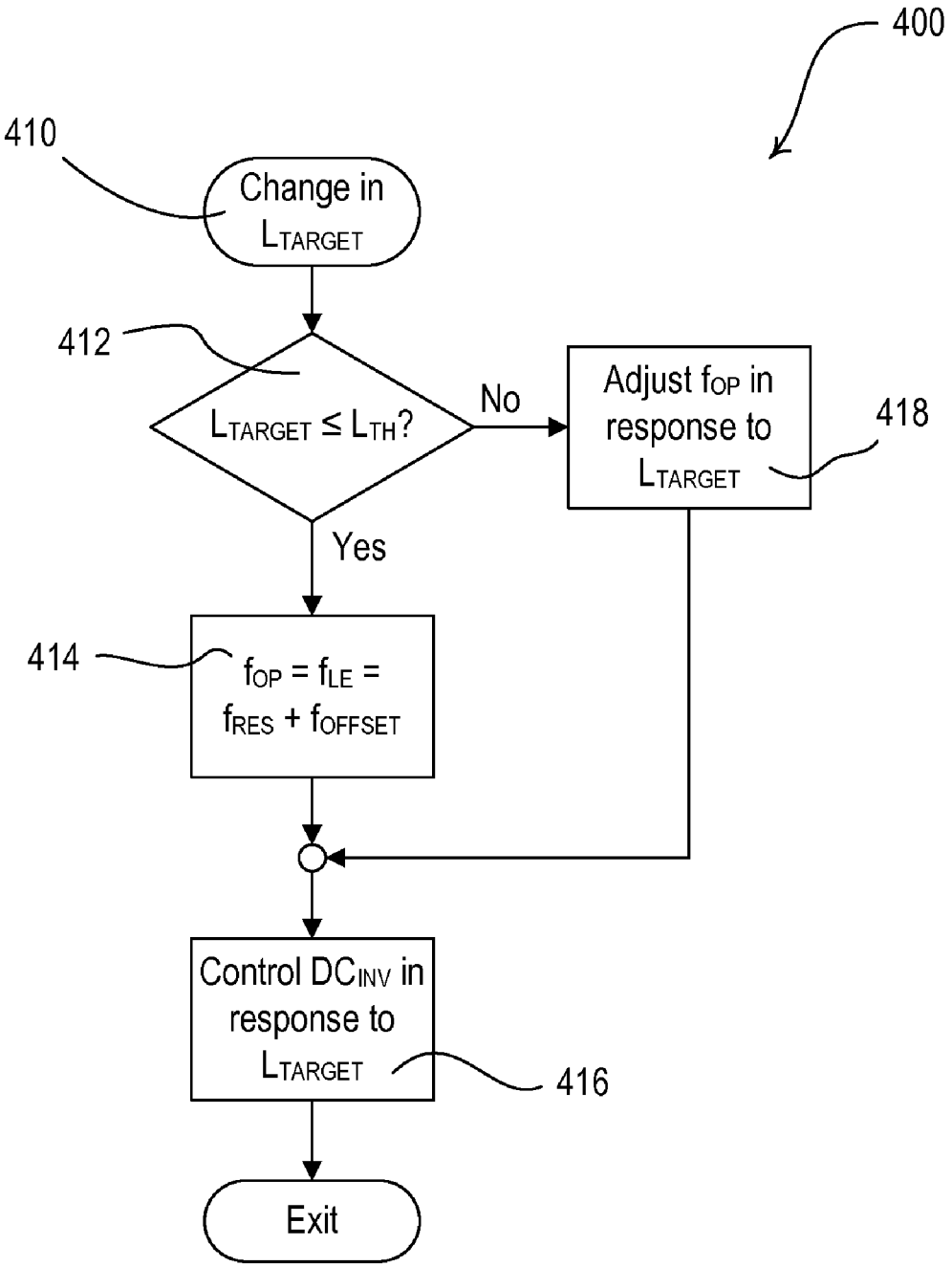
FIG. 6 is a simplified flowchart of a target intensity adjustment procedure executed by the microprocessor of the ballast of FIG. 1.

FIG. 6 is a simplified flowchart of a target intensity adjustment procedure 400, which is executed by the microprocessor 150 in response to changes to the target intensity $L_{TARGET}$ at step 410. If the target intensity $L_{TARGET}$ is less than or equal to the threshold intensity $L_{TH}$ (i.e., approximately 50%) at step 412, the microprocessor 150 controls the operating frequency $f_{OP}$ to the low-end operating frequency $f_{LE}$ (i.e., the approximation of the resonant frequency $f_{RES}$ plus the offset frequency $f_{OFFSET}$) at step 414. The microprocessor 150 then controls the duty cycle $DC_{INV}$ of the inverter output voltage $V_{INV}$ of the inverter circuit 130 in response to the target intensity $L_{TARGET}$ at step 416, and the target intensity adjustment procedure 400 exits. If the target intensity $L_{TARGET}$ is greater than the threshold intensity $L_{TH}$ at step 412, the microprocessor 150 adjusts the operating frequency $f_{OP}$ in response to the target intensity $L_{TARGET}$ at step 418, and controls the duty cycle $DC_{INV}$ of the inverter output voltage $V_{INV}$ in response to the target intensity $L_{TARGET}$ at step 416, before the target intensity adjustment procedure 400 exits.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electronic ballast for driving a gas discharge lamp, the ballast comprising:

an inverter circuit for converting a DC bus voltage to a high-frequency output voltage having an operating frequency and an operating duty cycle;

a resonant tank circuit characterized by a resonant frequency and operable to couple the high-frequency output voltage to the lamp to generate a lamp current through the lamp and a lamp voltage across the lamp; and a control circuit coupled to the inverter circuit for controlling the operating frequency and the operating duty cycle of the high-frequency output voltage, so as to adjust the intensity of the lamp to a target intensity, the control circuit operable to control the duty cycle of the high-frequency output voltage to adjust the magnitude of the lamp current through the lamp, so as to control the intensity of the lamp to the target intensity, the control circuit operable to control the operating frequency of the high-frequency output voltage to a low-end frequency when the target intensity of the lamp is at a low-end intensity;

wherein the control circuit is operable to determine an approximation of the resonant frequency of the resonant tank circuit, and to control the operating frequency of the high-frequency output voltage in response to the approximation of the resonant frequency and the target intensity of the lamp, the low-end frequency being an offset frequency away from the approximation of the resonant frequency.

2. An electronic ballast for driving a gas discharge lamp, the ballast comprising:

an inverter circuit for converting a DC bus voltage to a high-frequency output voltage having an operating frequency and an operating duty cycle;

a resonant tank circuit characterized by a resonant frequency and operable to couple the high-frequency output voltage to the lamp to generate a lamp current through the lamp and a lamp voltage across the lamp; and a control circuit coupled to the inverter circuit for controlling the operating frequency and the operating duty cycle of the high-frequency output voltage, so as to adjust the intensity of the lamp to a target intensity;

wherein the control circuit is operable to determine an approximation of the resonant frequency of the resonant tank circuit by controlling the duty cycle of the high-frequency output voltage to a minimum value, subsequently adjusting the operating frequency of the high-frequency output voltage from a frequency above the resonant frequency of the resonant tank circuit down towards the resonant frequency, measuring the magnitude of the lamp voltage, and storing the present value of the operating frequency of the high-frequency output voltage as the resonant frequency when the magnitude of the lamp voltage reaches a maximum value, the control circuit further operable to control the operating frequency of the high-frequency output voltage in response to the approximation of the resonant frequency and the target intensity of the lamp.

3. The ballast of claim 1, wherein the low-end frequency is the offset frequency above the approximation of the resonant frequency.

4. The ballast of claim 1, wherein the control circuit is operable to determine the approximation of the resonant frequency of the resonant tank circuit prior to preheating filaments of the lamp and attempting to strike the lamp.

5. The ballast of claim 1, wherein the control circuit is operable to determine the approximation of the resonant frequency of the resonant tank circuit immediately after turning the lamp off.

6. The ballast of claim 1, wherein the control circuit is operable to periodically determine the approximation of the resonant frequency of the resonant tank circuit when the lamp is off.

7. The ballast of claim 1, wherein the control circuit is operable to determine the approximation of the resonant frequency of the resonant tank circuit during manufacturing of the ballast.

8. The ballast of claim 1, wherein the control circuit is operable to determine the approximation of the resonant frequency by measuring the resonant frequency of the resonant tank circuit.

9. A method of driving a gas discharge lamp in an electronic dimming ballast having a resonant tank circuit characterized by a resonant frequency, the method comprising:

providing a high-frequency output voltage having an operating frequency and an operating duty cycle to the resonant tank circuit;

the resonant tank circuit coupling the high-frequency output voltage to the lamp to generate a lamp current through the lamp and a lamp voltage across the lamp;

controlling the operating duty cycle of the high-frequency output voltage, so as to adjust the intensity of the lamp to a target intensity;

determining an approximation of the resonant frequency of the resonant tank circuit; and automatically adjusting the operating frequency of the high-frequency output voltage in response to the approximation of the resonant frequency and the target intensity of the lamp by controlling the operating frequency of the high-frequency output voltage to a low-end frequency when the target intensity of the lamp is at a low-end intensity, the low-end frequency being an offset frequency above the approximation of the resonant frequency.

10. The method of claim 9, wherein determining the approximation of the resonant frequency of the resonant tank circuit further comprises determining the approximation of the resonant frequency of the resonant tank circuit prior to preheating filaments of the lamp and attempting to strike the lamp.

11. The method of claim 9, wherein determining the approximation of the resonant frequency of the resonant tank circuit further comprises determining the approximation of the resonant frequency of the resonant tank circuit prior to turning the lamp off.

12. The method of claim 9, wherein determining the approximation of the resonant frequency of the resonant tank circuit further comprises periodically determining the approximation of the resonant frequency of the resonant tank circuit when the lamp is off.

13. A method of driving a gas discharge lamp in an electronic dimming ballast having a resonant tank circuit characterized by a resonant frequency, the method comprising:

providing a high-frequency output voltage having an operating frequency and an operating duty cycle to the resonant tank circuit;

the resonant tank circuit coupling the high-frequency output voltage to the lamp to generate a lamp current through the lamp and a lamp voltage across the lamp;

controlling the operating duty cycle of the high-frequency output voltage, so as to adjust the intensity of the lamp to a target intensity;

controlling the duty cycle of the high-frequency output voltage to a minimum value;

subsequently adjusting the operating frequency of the high-frequency output voltage from a frequency above the resonant frequency of the resonant tank circuit down towards the resonant frequency;

measuring the magnitude of the lamp voltage in response to adjusting the operating frequency of the high-frequency output voltage; and storing the present value of the operating frequency of the high-frequency output voltage as an approximation of the resonant frequency when the magnitude of the lamp voltage reaches a maximum value; and automatically adjusting the operating frequency of the high-frequency output voltage in response to the approximation of the resonant frequency and the target intensity of the lamp.

14. The method of claim 13, further comprising:

comparing the measured magnitude of the lamp voltage to the present maximum value of the lamp voltage prior to storing the present value of the operating frequency of the high-frequency output voltage as the resonant frequency.

15. A method of determining the approximation of a resonant frequency of a resonant tank circuit of an electronic ballast for driving a gas discharge lamp, the method comprising:

providing a high-frequency output voltage having an operating frequency and an operating duty cycle to the resonant tank circuit;

the resonant tank circuit coupling the high-frequency output voltage to the lamp to generate a lamp current through the lamp and a lamp voltage across the lamp;

controlling the duty cycle of the high-frequency output voltage to a minimum value;

subsequently adjusting the operating frequency of the high-frequency output voltage from a frequency above the resonant frequency of the resonant tank circuit down towards the resonant frequency;

measuring the magnitude of the lamp voltage; and storing the present value of the operating frequency of the high-frequency output voltage as the resonant frequency when the magnitude of the lamp voltage reaches a maximum value.

16. The method of claim 15, further comprising:

comparing the measured magnitude of the lamp voltage to the present maximum value of the lamp voltage prior to storing the present value of the operating frequency of the high-frequency output voltage as the resonant frequency.

17. A method of determining the approximation of a resonant frequency of a resonant tank circuit of an electronic ballast for driving a gas discharge lamp, the method comprising:

providing a high-frequency output voltage having an operating frequency and an operating duty cycle to the resonant tank circuit;

the resonant tank circuit coupling the high-frequency output voltage to the lamp to generate a lamp current through the lamp and a lamp voltage across the lamp;

adjusting the operating frequency of the high-frequency output voltage from a frequency above the resonant frequency of the resonant tank circuit down towards the resonant frequency;

measuring the magnitude of the lamp voltage;

storing the present value of the operating frequency of the high-frequency output voltage as the resonant frequency when the magnitude of the lamp voltage reaches a maximum value; and controlling the operating frequency of the high-frequency output voltage to a low-end frequency when the target intensity of the lamp is at a low-end intensity, the low-end frequency being an offset frequency above the measured resonant frequency.

* * * * *